US010115376B2

(12) United States Patent
Yu et al.

(10) Patent No.: US 10,115,376 B2
(45) Date of Patent: Oct. 30, 2018

(54) DISPLAY APPARATUS AND METHOD OF DRIVING THE SAME

(71) Applicant: SAMSUNG DISPLAY CO., LTD., Yongin-si, Gyeonggi-do (KR)

(72) Inventors: Han-Sol Yu, Suwon-si (KR); Jong-Tae Kim, Seoul (KR); Su-Cheol Kang, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 127 days.

(21) Appl. No.: 15/214,711

(22) Filed: Jul. 20, 2016

(65) Prior Publication Data

US 2017/0053625 A1 Feb. 23, 2017

(30) Foreign Application Priority Data

Aug. 17, 2015 (KR) ..... 10-2015-0115620

(51) Int. Cl.

| | |
|---|---|
| ***G09G 5/39*** | (2006.01) |
| ***G09G 5/393*** | (2006.01) |
| ***G09G 3/34*** | (2006.01) |
| ***G09G 3/36*** | (2006.01) |
| ***G09G 5/10*** | (2006.01) |

(Continued)

(52) U.S. Cl.

CPC ..... *G09G 5/393* (2013.01); *G09G 3/2092* (2013.01); *G09G 3/2096* (2013.01); *G09G 3/34* (2013.01); *G09G 3/3406* (2013.01); *G09G 3/3618* (2013.01); *G09G 5/10* (2013.01); *G09G 5/12* (2013.01); *G09G 2310/0245* (2013.01); *G09G 2310/08* (2013.01); *G09G 2320/0247* (2013.01); *G09G 2320/0271* (2013.01); *G09G 2320/0276* (2013.01); *G09G 2320/0285* (2013.01);

(Continued)

(58) Field of Classification Search

None

See application file for complete search history.

(56) References Cited

U.S. PATENT DOCUMENTS

| | | | | |
|---|---|---|---|---|
| 2013/0076760 | A1 | 3/2013 | Han et al. | |
| 2014/0055501 | A1 | 2/2014 | Shin et al. | |
| 2016/0379584 | A1* | 12/2016 | Onishi ..... | G09G 3/3648 345/691 |

FOREIGN PATENT DOCUMENTS

| | | |
|---|---|---|
| EP | 2889868 | 7/2015 |
| KR | 1020130091167 | 8/2013 |
| KR | 101307557 | 9/2013 |

OTHER PUBLICATIONS

European Search Report dated Dec. 13, 2016 in corresponding European Patent Application No. 16182031.0.

* cited by examiner

*Primary Examiner* — Joseph Haley

(74) *Attorney, Agent, or Firm* — F. Chau & Associates, LLC

(57) ABSTRACT

A display apparatus includes a display panel displaying a normal image in a normal mode and displays a static image in a PSR (Panel Self Refresh) mode, a memory storing refresh image data corresponding to the static image, a comparator comparing image data of an N-th frame received from a graphics processor and refresh image data readout from the memory, a compensator generating a compensation value based on a comparison result and adding the compensation value to the refresh image data, and a data driver generating a data voltage using the refresh image data compensated by the comparator and outputting the data voltage to the display panel.

18 Claims, 4 Drawing Sheets

(51) Int. Cl.
*G09G 5/12* (2006.01)
*G09G 3/20* (2006.01)

(52) U.S. Cl.
CPC ..... *G09G 2320/0646* (2013.01); *G09G 2330/021* (2013.01); *G09G 2360/127* (2013.01)

DISPLAY APPARATUS AND METHOD OF DRIVING THE SAME

This application claims priority from and the benefit of Korean Patent Application No. 10-2015-0115620 filed on Aug. 17, 2015, which is hereby incorporated by reference for all purposes as if fully set forth herein.

FIELD OF INVENTION

Exemplary embodiments of the inventive concept relate to a display apparatus and method of driving a display apparatus. More particularly, example embodiments of the inventive concept relate to improving a display quality of a display apparatus using panel self refresh technology and a method of driving the same.

DISCUSSION OF THE RELATED ART

Mobile phones may contain a high resolution display. The high resolution display receives an image signal from a host through a display drive IC to display the image signal. When a display in a mobile device as described above receives a still image to display from the host, power may be consumed when accessing a memory and an interface of the host.

An embedded display port (eDP) standard has been announced by VESA (Video Electronics Standard Association). The eDP standard is an interface standard corresponding to a display port (DP) interface designed for devices equipped with a display such as a lap-top computer, a tablet PC, a net book, and an all-in-one desktop PC. The eDP v1.3 standard includes panel self-refresh (PSR) technology.

PSR technology may reduce power usage in a system and extends a life span of a battery in a portable PC environment. PSR technology may display an image while minimizing power consumption by using a memory installed in a display, significantly increasing battery life in a portable PC environment.

A driving signal of a display panel is generated in response to an input data signal transmitted from a host in normal mode. The driving signal is generated based on a stop image data stored in a frame buffer included in the display device during the PSR mode.

SUMMARY

According to an exemplary embodiment of the inventive concept, there is provided a display apparatus. The display apparatus includes a display panel, a memory, a comparator, a compensator and a data driver. The display panel displaying a normal image in a normal mode and displaying a static image in a PSR (Panel Self Refresh) mode. The memory stores a refresh image data corresponding to the static image. The comparator compares image data of an N-th frame received from a graphics processor and refresh image data readout from the memory. The compensator generates a compensation value based on a comparison result and adding the compensation value to the refresh image data. The data driver generates a data voltage using refresh image data compensated by the compensator and outputting the data voltage to the display panel.

In an exemplary embodiment of the inventive concept, the display apparatus may further include a compensation controller receiving a PSR starting signal for controlling a start of the PSR mode, a PSR ending signal for controlling an end of the PSR mode, and a re-synchronization ending signal for controlling a start of the normal mode.

In an exemplary embodiment of the inventive concept, the compensation controller may control the comparator and the compensator based on the PSR staring signal and the PSR ending signal.

In an exemplary embodiment of the inventive concept, the compensator may be configured to generate the compensation value for compensating a grayscale difference between the image data of the N-th frame and the refresh image data.

In an exemplary embodiment of the inventive concept, the display panel may be driven with a re-synchronization mode between the PSR mode and the normal mode. The re-synchronization mode synchronizes a panel synchronization signal for driving the display panel with an original synchronization signal received from the graphics processor.

In an exemplary embodiment of the inventive concept, the display apparatus may further include a light-source, a light-source driver and a luminance controller. The light-source may provide the display panel with a light. The light-source driver may control a luminance level of the light. The luminance controller may control the light-source driver to generate a boosting light of a boosting luminance level in the re-synchronization mode. The boosting luminance level may be higher than a normal luminance level of a normal light generated in the PSR mode and the normal mode.

In an exemplary embodiment of the inventive concept, the luminance controller may include a look-up table storing a plurality of boosting luminance levels depending on charging characteristics of the display panel.

In an exemplary embodiment of the inventive concept, the compensation controller may be configured to control a luminance controller based on the PSR ending signal and the re-synchronization ending signal.

According to an exemplary embodiment of the inventive concept, a method of driving a display apparatus is provided. The method includes storing refresh image data corresponding to a static image in a memory, comparing image data of an N-th frame received from a graphics processor and the refresh image data readout from the memory, generating a compensation value based on a comparison result of the image data of an N-th frame and the refresh image data, adding the compensation value to the refresh image data, and driving a display panel using refresh image data added to the compensation value.

In an exemplary embodiment of the inventive concept, the method may further include displaying by the display panel a normal image in a normal mode and displaying a static image in a PSR (Panel Self Refresh) mode. The display panel may receive a PSR starting signal for controlling a start of the PSR mode, a PSR ending signal for controlling an end of the PSR, and a re-synchronization ending signal for controlling a start of the normal mode.

In an exemplary embodiment of the inventive concept, the method may further include determining a PSR period when the display panel is driven in the PSR mode, based on the PSR starting signal and the PSR ending signal, and driving the display panel using the refresh image data added to the compensation value during the PSR period.

In an exemplary embodiment of the inventive concept, the compensation value may correspond to a grayscale difference between the image data of the N-th frame and the refresh image data.

In an exemplary embodiment of the inventive concept, the method may further include driving the display panel in a re-synchronization mode inserted between the PSR mode and the normal mode. The re-synchronization mode may synchronize a panel synchronization signal for driving the display panel with an original synchronization signal.

In an exemplary embodiment of the inventive concept, the method may further include providing the display panel with a boosting light during the re-synchronization mode. The boosting light has a boosting luminance level greater than a normal luminance level of a normal light generated during the PSR mode and the normal mode.

In an exemplary embodiment of the inventive concept, the boosting luminance level may be determined using a look-up table storing a plurality of boosting luminance levels depending on charging characteristics of the display panel.

In an exemplary embodiment of the inventive concept, the method may further include determining a re-synchronization period when the display panel is driven in the re-synchronization mode, based on the PSR ending signal and the re-synchronization ending signal.

According to an exemplary embodiment of the inventive concept, there is provided a display apparatus. The display apparatus includes a timing controller. The timing controller includes a compensation controller, a memory, a comparator and a compensator. The compensation controller may output a normal image in a normal mode or a static image in a PSR (Panel Self Refresh) mode, control the comparator and the compensator and generate a refresh image data by compressing an image data of an N-th frame. The memory may store the refresh image data. The comparator may generate a grayscale difference based on a comparison between the image data of the N-th frame and the refresh image data. The compensator may determine a compensation value based on the grayscale difference and add the compensation value and the refresh image data.

In an exemplary embodiment of the inventive concept, the display apparatus may include a display panel and a data driver. The data driver generates a data voltage based on the compensation value added to the refresh image data and outputting the data voltage to the display panel.

In an exemplary embodiment of the inventive concept, the compensation controller may receive a PSR starting signal and a PSR ending signal from a graphics processor, may determine a PSR period of the PSR mode based on the PSR starting signal and the PSR ending signal, and may operate the comparator and the compensator during the PSR period.

In an exemplary embodiment of the inventive concept, the compensation controller may activate a luminance controller when the PSR ending signal is received, and the compensation controller may deactivate the luminance controller when a re-synchronization ending signal is received.

In an exemplary embodiment of the inventive concept, the display apparatus may include a light source, a light-source driver and a luminance controller. The light source may provide the display panel with a light. The light-source driver may control a luminance level of the light. The luminance controller may include a luminance look-up table. The look-up table may store a plurality of boosting luminance levels depending on charging characteristics of the display panel. The luminance controller may provide the light-source driver with a boosting luminance level based on a control signal from the compensation controller.

BRIEF DESCRIPTION OF THE DRAWINGS

The above and other features of the inventive concept will become more apparent by describing in detailed exemplary embodiments thereof with reference to the accompanying drawings, in which.

DETAILED DESCRIPTION

Hereinafter, embodiments of the inventive concept will be explained in detail with reference to the accompanying drawings.

Figure 1:
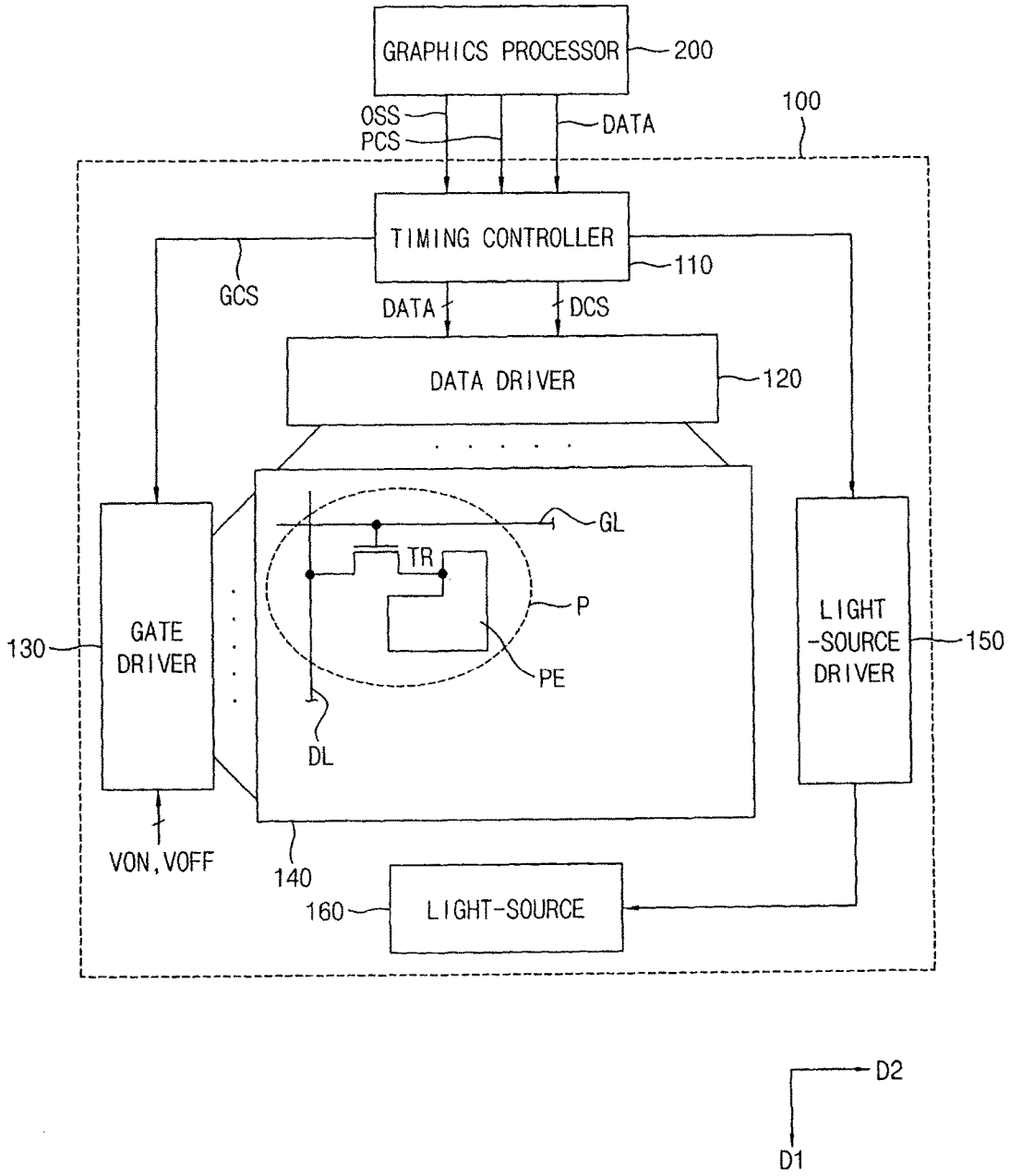
FIG. 1 is a block diagram illustrating a display apparatus according to an exemplary embodiment.

FIG. 1 is a block diagram illustrating a display apparatus according to an exemplary embodiment.

Referring to FIG. 1, the display apparatus 100 may include a timing controller 110, a data driver 120, a gate driver 130, a display panel 140, a light-source driver 150 and a light-source 160.

The timing controller 110 is configured to receive an original synchronization signal OSS, a PSR (Panel Self Refresh) command signal (PCS) and image data DATA from a graphics processor 200. The PCS may include a PSR starting signal for starting a PSR mode, a PSR ending signal for ending the PSR mode and a re-synchronization ending signal for ending a re-synchronization mode which is immediately followed by the PSR mode.

The timing controller 110 is configured to generate a panel synchronization signal for driving the display panel 140 based on the original synchronization signal. The panel synchronization signal may include a data control signal (DCS), which includes a data enable signal, a vertical synchronization signal and a horizontal synchronization signal for controlling the data driver 120 and a gate control signal GCS which includes a gate enable signal, a vertical start signal and a clock signal for controlling the gate driver 130.

The timing controller 110 is configured to drive the display apparatus 100 in a normal mode or a PSR mode based on the PCS.

According to an exemplary embodiment, when the PSR starting signal for PSR mode is received, the timing controller 110 is configured to compare image data received from the graphics processor 200 and refresh image data readout from the memory of the display apparatus. The image data and the refresh image data are compared to calculate loss data of the refresh image data with respect to the received image data and to compensate for the loss data in the refresh image data. In addition, the timing controller 110 is configured to control the light-source 160. The light-source 160 may generate a boosting light in a re-synchronization mode, which is immediately followed by the PSR mode and synchronizes the panel synchronization signal used in the PSR mode with an original synchronization signal used in the normal mode, such that decreasing luminance resulting from the data charge of the display panel 140 being greatly reduced may be compensated for in the re-synchronization mode.

The data driver 120 is configured to convert image data received from the timing controller 110 to a data voltage and to output the data voltage to a data line DL of the display panel 140, based on the data control signal DCS.

The gate driver 130 is configured to generate a gate signal and to output the gate signal to a gate line GL of the display panel 140, based on the gate control signal GCS. The gate signal has a gate-on voltage VON and a gate-off voltage VOFF.

The display panel 140 may include a plurality of data lines DL, a plurality of gate lines GL and a plurality of pixels P.

The plurality of data lines DL extend in a first direction D1 and is arranged in a second direction D2 crossing the first direction D1. The plurality of gate lines GL extends in the second direction D2 and is arranged in the first direction D1. The first direction D1 and the second direction D2 are substantially perpendicular to each other. Each of the pixels P may include a thin film transistor TR which is connected to a data line DL and a gate line GL and a pixel electrode PE which is connected to the thin film transistor TR.

The light-source driver 150 is configured to generate a light-source driving signal for driving the light-source 160 and to provide the light-source driving signal to the light-source 160. The light-source driver 150 is configured to control the light-source 160. The light-source 160 generates a boosting light corresponding to a boosting luminance level preset corresponding to the display panel 140 in the re-synchronization mode.

The light-source 160 may include at least one light emitting diode (LED) and is configured to generate a light having a luminance corresponding to the light-source driving signal.

For example, a user of a mobile device, e.g. a laptop or a smart phone, may be viewing a substantially static image. In this example, the mobile device may initiate the PSR mode automatically or based on a user's input. In PSR mode multiple energy saving features are activated including no longer transmitting image data from the graphics processor to the timing controller. The display apparatus may have a different frame rate in the PSR mode than in the normal mode. PSR mode may conclude either automatically, when the mobile device detects a more dynamic image, or based on a user's input when the timing controller receives a PSR ending signal. When transitioning back to a normal mode, the timing controller may have to extend a vertical black period to allow the display panel to synchronize with the period of the normal mode. To reduce the likelihood of the user seeing a flicker the timing controller may transmit a light-source driving signal indicating a boosting light level to the light-source driver.

Figure 2:
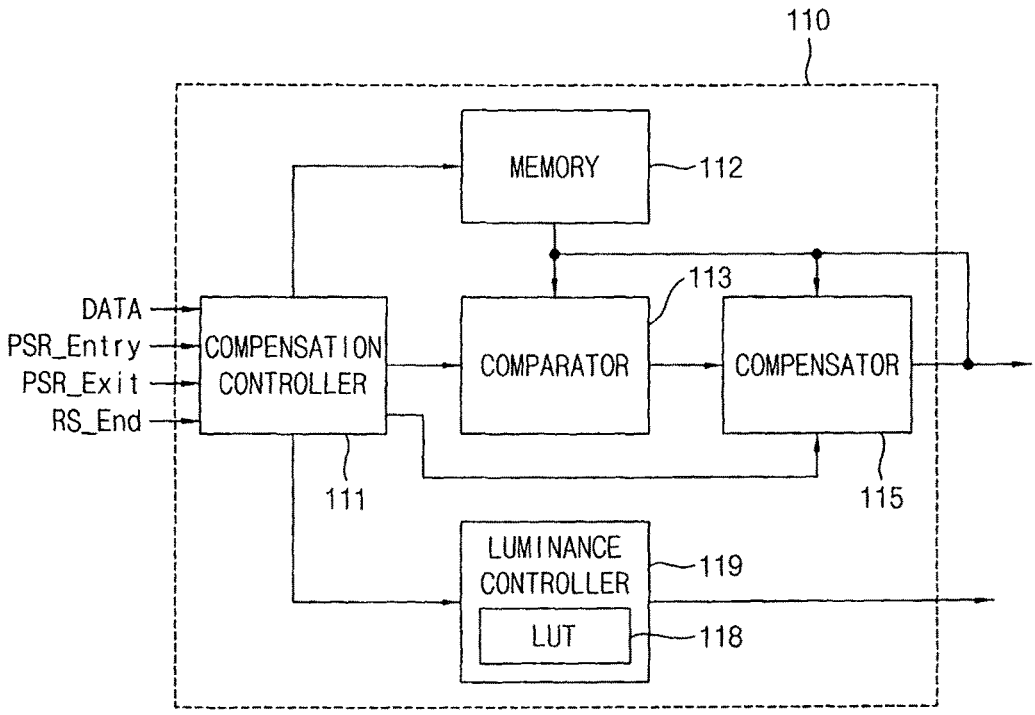
FIG. 2 is a block diagram illustrating a timing controller of FIG. 1 according to an exemplary embodiment.

FIG. 2 is a block diagram illustrating a timing controller of FIG. 1.

Referring to FIGS. 1 and 2, the timing controller 110 may include a compensation controller 111, a memory 112, a comparator 113, a compensator 115 and a luminance controller 119.

The compensation controller 111 is configured to determine a PSR period during which the display panel 140 is driven in the PSR mode, based on the PSR starting signal PSR_Entry and the PSR ending signal PSR_Exit, and to control the comparator 113 and the compensator 115.

When the PSR starting signal PSR_Entry is received, the compensation controller 111 is configured to turn on the comparator 113 and the compensator 115. When the PSR ending signal PSR_Exit is received, the compensation controller 111 is configured to turn off the comparator 113 and the compensator 115.

For example, when the PSR starting signal PSR_Entry is received, the compensation controller 111 is configured to compress high-resolution image data of an N-th frame received from the graphics processor 200 into refresh image data of the N-th frame. The refresh image data of the N-th frame has a low-resolution generated by a compression algorithm. The compensation controller 111 is configured to store the refresh image data of the N-th frame in the memory 112.

The memory 112 is configured to store the refresh image data of the N-th frame. The refresh image data of the N-th frame is the image data corresponding to the static image displayed on the display panel 140 in the PSR mode.

When the PSR starting signal PSR_Entry is received, the comparator 113 is configured to compare the image data of the N-th frame received from the graphics processor 200 and the refresh image data of the N-th frame readout from the memory 112. The compensation controller 111 is configured to operate the compensator 115 for a PSR period. The compensation controller 111 determines the PSR period of the PSR mode based on the PSR starting signal PSR_Entry and the PSR ending signal PSR_Exit.

The compensator 115 is configured to calculate a grayscale difference between the image data of the N-th frame and the refresh image data of the N-th frame based on a comparison result from the comparator 113. For example, the compensator 115 may be configured to calculate a grayscale difference between the image data of the N-th frame and the refresh image data of the N-th frame corresponding to a plurality of sample pixels sampled from a plurality of pixels P of the image data of the N-th frame. The compensator 115 may be configured to determine a compensation value ΔG for compensating the difference between the image data of the N-th frame and the refresh image data of the N-th frame, e.g. a grayscale difference.

The compensator 115 is configured to uniformly add the compensation value ΔG to the refresh image data of the N-th frame readout from the memory 112. The combination of the refresh image data of the N-th frame and the compensation value ΔG are provided to the data driver 120.

Then, when the PSR ending signal PSR_Exit is received, the compensation controller 111 is configured to turn off the comparator 113 and the compensator 115. The refresh image data of the N-th frame readout from the memory 112 may be provided to the data driver 120 without the compensation value ΔG determined by the comparator 113 and generated by the compensator 115.

According to an exemplary embodiment, the refresh image data of the N-th frame compressed by the compression algorithm is compensated in the PSR mode and the flicker occurring based on the luminance difference of the display panel between the PSR mode and the normal mode may be decreased or eliminated.

The luminance controller 119 may include a luminance look-up table (LUT) 118, and the luminance LUT is configured to provide the light-source driver 150 with a boosting luminance level based on a control signal from the compensation controller 111. The luminance LUT is configured to store a plurality of boosting luminance levels depending on physical characteristics of the display panel 140. The characteristics of the display panel 140 may include a charging characteristic.

The compensation controller 111 is configured to determine a re-synchronization period during following the PSR period. The display panel 140 is driven in the re-synchronization mode based on the PSR ending signal PSR_Exit and the re-synchronization ending signal RS_End. The compensation controller 111 may control an operation of the luminance controller 119. For example, when the PSR ending signal PSR_Exit is received, the compensation controller 111 may be configured to turn on the luminance controller 119 and when the re-synchronization ending signal RS_End is received, the compensation controller 111 may be configured to turn off the luminance controller 119.

The light-source driver 150 is configured to generate a light-source driving signal for driving the light-source 160. According to an exemplary embodiment, the light-source driver 150 is configured to generate the light-source driving signal corresponding to the boosting luminance level provided from the luminance controller 119 in the re-synchronization mode. The light-source driver 150 is configured to provide the light-source 160 with the light-source driving signal for the boosting luminance level. The light-source 160 may generate a boosting light in the re-synchronization mode.

The light-source driver 150 is configured to generate a light-source driving signal of a normal luminance level in the normal mode and the PSR mode. The light-source driver 150 is configured to provide the light-source driving signal of the normal luminance level to the light-source 160. Thus, the light-source 160 generates a normal luminance light during the PSR mode and the normal mode. In a further exemplary embodiment, the light-source driver 150 may be configured to generate the light-source driving signal corresponding to the normal luminance level in the normal mode and the PSR mode. The light-source driver signal of the normal luminance level, in the PSR mode and the normal mode, may be provided by the luminance controller 119 and provided to the light-source 160.

The re-synchronization mode is inserted between the PSR mode and the normal mode. A synchronization signal of the PSR mode, which is the panel synchronization signal generated from the timing controller 110, is synchronized with a synchronization signal of the normal mode, which is the original synchronization signal received from the graphics processor. In the re-synchronization mode, a vertical blanking period in a frame period of the panel synchronization signal may increase and an active period in the frame period of the panel synchronization signal may decrease. In the re-synchronization mode, a charging period of the display panel 140 may be decreased by decreasing active period and thus a luminance of an image displayed on the display panel 140 may be decreased.

According to an exemplary embodiment, decreasing luminance of the display panel 140 may be compensated by the boosting light generated from the light-source 160 in the re-synchronization mode. A reduced luminance difference between the PSR mode and the normal mode may decrease or eliminate a flicker.

Figure 3:
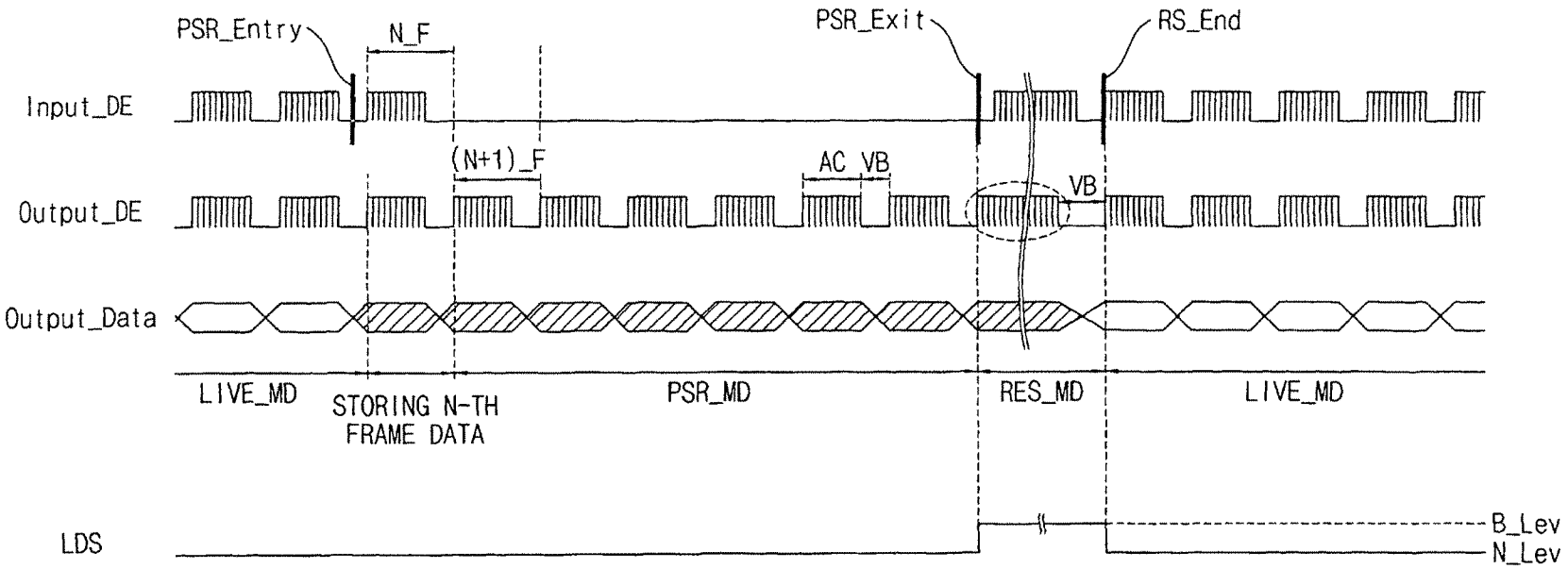
FIG. 3 is a waveform diagram illustrating a method of driving a display apparatus according to an exemplary embodiment.
Figure 4:
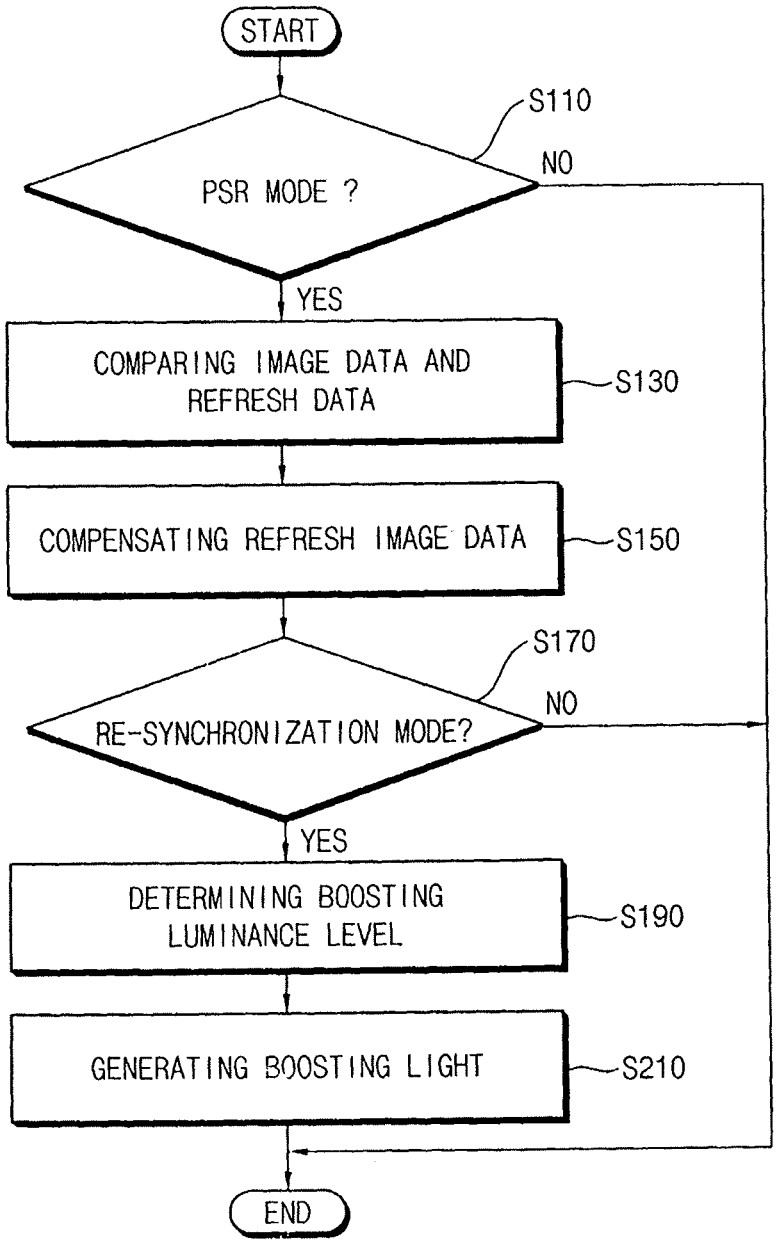
FIG. 4 is a flowchart illustrating a method of driving a display apparatus according to an exemplary embodiment.

FIG. 3 is a waveform diagram illustrating a method of driving a display apparatus according to an exemplary embodiment. FIG. 4 is a flowchart illustrating a method of driving a display apparatus according to an exemplary embodiment.

Referring to FIGS. 2 to 4, the graphics processor 200 is configured to transmit image data DATA, an original synchronization signal which includes a data enable signal Input_DE and a PSR command signal to the timing controller 110 of the display apparatus 100. The PSR command signal may include a PSR starting signal PSR_Entry, a PSR ending signal PSR_Exit and a re-synchronization ending signal RS_End.

The timing controller 110 is configured to generate a panel synchronization signal which includes the data enable signal Output_DE for driving the display panel 140 based on the original synchronization signal Input_DE.

According to an exemplary embodiment, in response to the PSR starting signal PSR_Entry, the PSR ending signal PSR_Exit and re-synchronization ending signal RS_End, the timing controller 110 is configured to compensate the refresh image data compressed by a compression algorithm in the PSR mode. The timing controller 110 may compensate a luminance of the display panel 140 using a boosting light in the re-synchronization mode.

When the image data DATA changes from a normal image to a static image, the graphics processor 200 is configured to transmit the PSR starting signal PSR_Entry to the timing controller 110 of the display apparatus 100.

The compensation controller 111 is configured to compress image data of an N-th frame through a compression algorithm in response to the PSR starting signal PSR_Entry. The image data of the N-th frame may have a period of N_F. The compensation controller 111 is further configured to store the image data of the N-th frame compressed by the compression algorithm as refresh image data in the memory 112.

When the refresh image data of the N-th frame is stored in the memory 112, the graphics processor 200 is configured to turn off a transmission channel for transmitting the image data and the original synchronization signal to the display apparatus 100.

The timing controller 110 is configured to generate a panel synchronization signal which includes a data enable signal Output_DE of a PSR mode PSR_MD for displaying the static image on the display panel 140. In the PSR mode PSR_MD, the panel synchronization signal Output_DE of the PSR mode PSR_MD may be generated based on an output signal from an oscillator in the timing controller 110. The Output_DE signal may have an (N+1)-th frame period (N+1)_F. The Output_DE signal may have a high voltage period AC and a low voltage period, e.g. a vertical blank period VB. The panel synchronization signal Output_DE of the PSR mode PSR_MD may have a frame rate lower than an original frame rate of the original synchronization signal INPUT_DE, or a frame rate substantially similar to the original frame rate.

The compensation controller 111 is configured to turn on the comparator 113 and the compensator 115 in response to the PSR starting signal PSR_Entry (Step S110).

The comparator 113 is configured to compare the image data received from the graphics processor 200 and the refresh image data readout from the memory 112 (Step S130).

The compensator 115 is configured to calculate a grayscale difference between the image data of the N-th frame and the refresh image data of the N-th frame based on a comparison result of the comparator 113. For example, the compensator 115 may be configured to calculate a grayscale difference between the image data of the N-th frame and the refresh image data of the N-th frame corresponding to a plurality of sample pixels sampled from a plurality of pixels of the image data of the N-th frame. The compensator 115 may be configured to determine a compensation value ΔG for compensating the difference between the image data of the N-th frame and the refresh image data of the N-th frame, e.g. a grayscale difference.

The compensator 115 is configured to uniformly add the compensation value ΔG to the refresh image data of the N-th frame readout from the memory 112 (Step S150).

The refresh image data of the N-th frame added to the compensation value ΔG is provided to the data driver 120.

In the PSR mode PSR_MD, the display apparatus 100 displays the refresh image data of the N-th frame added to the compensation value ΔG as the static image on the display panel 140 from the (N+1)-th frame period.

Then, when the image data changes from the static image to the normal image, the graphics processor 100 is configured to transmit PSR ending signal PSR_Exit to the timing controller 110 such that a driving mode of the display apparatus 100 changes from the PSR mode PSR_MD to the normal mode LIVE_MD.

The compensation controller 111 is configured to turn off an operation of the comparator 113 in response to the PSR ending signal PSR_Exit.

According to an exemplary embodiment, the refresh image data of the N-th frame compressed by the compression algorithm is compensated in the PSR mode. A reduced luminance difference between the PSR mode and the normal mode may decrease or eliminate a flicker.

The graphics processor 100 is configured to turn on a transmission channel through which the image data and the original synchronization signal are transmitted to the display apparatus 100.

The timing controller 110 is configured to drive the display apparatus 100 with the re-synchronization mode RES_MD in response to the PSR ending signal PSR_Exit during a predetermined period (Step S170).

In the re-synchronization mode RES_MD, the vertical blanking period VB of the panel synchronization signal Output_DE is adjusted for synchronizing the panel synchronization signal Output_DE with the original synchronization signal Input_DE.

The vertical blanking period VB of the panel synchronization signal Output_DE used in the PSR mode PSR_MD is driven with a low frequency The vertical blanking period VB of the panel synchronization signal Output_DE used in the PSR mode PSR_MD is longer than a vertical blanking period VB of the panel synchronization signal Output_DE used in the normal mode LIVE_MD. The vertical blanking period VB of the panel synchronization signal Output_DE used in the normal mode LIVE_MD is driven with a high frequency. During the re-synchronization mode RES_MD, the vertical blanking period of the panel synchronization signal Output_DE may be increased. Generally, when the vertical blanking period VB in one frame period increases, the active period in one frame period decreases. The data charging period, during which the data voltage is charged in the display panel 140, may decrease and a luminance of an image displayed on the display panel may decrease.

The compensation controller 111 is configured to turn on the luminance controller 119 in response to the PSR ending signal PSR_Exit (Step S170).

The luminance controller 119 is configured to determine a boosting luminance level B_Lev corresponding to the display panel 140 using the luminance LUT 118 (Step S190).

The luminance controller 119 is configured to provide the light-source driver 150 with the boosting luminance level B_Lev. The light-source driver 150 is configured to generate a light-source driving signal LDS of the boosting luminance level B_Lev for driving the light-source 160. The boosting luminance level B_Lev is higher than a normal luminance level N_Lev of the normal mode LIVE_MD and the PSR mode PSR_MD.

The light-source 160 is configured to provide the display panel 140 with a boosting light corresponding to the boosting luminance level B_Lev (Step S210).

When the re-synchronization ending signal RS_End is received, the compensation controller 111 is configured to control the luminance controller 119 to provide the light-source driver 150 with the normal luminance level N_Lev. In a further example, when the re-synchronization ending signal RS_End is received, the compensation controller 111 may be configured to turn off an operation of the luminance controller 119. In this example, the light-source driver 150 is configured to independently generate the light-source driving signal LDS for the normal luminance level N_Lev.

According to an exemplary embodiment, decreasing luminance of the display panel 140 may be compensated by the boosting light generated from the light-source 160 in the re-synchronization mode RES_MD. A reduced luminance difference between the PSR mode and the normal mode may decrease or eliminate a flicker.

As described above, according to exemplary embodiments, the refresh image data of the N-th frame compressed by the compression algorithm is compensated in the PSR mode and thus, flicker by luminance difference of the display panel between the PSR mode and the normal mode may be decreased or eliminated. In addition, decreasing luminance of the display panel may be compensated by the boosting light generated from the light-source in the re-synchronization mode.

The foregoing is illustrative of the inventive concept and is not to be construed as limiting thereof. Although a few exemplary embodiments of the inventive concept have been described, those skilled in the art will readily appreciate that many modifications are possible in the exemplary embodiments without materially departing from the novel teachings of the inventive concept. Accordingly, such modifications are intended to be included within the scope of the inventive concept as defined in the claims. It is to be understood that the foregoing is illustrative of the inventive concept and is not to be construed as limited to the exemplary embodiments disclosed, and that modifications to the disclosed exemplary embodiments, as well as other exemplary embodiments, are intended to be included within the scope of the appended claims. The inventive concept is defined by the following claims, with equivalents of the claims to be included therein.

What is claimed is:

1. A display apparatus comprising:

a display panel configured to display a normal image in a normal mode and display a static image in a PSR (Panel Self Refresh) mode;

a compensation controller configured to compress image data of an N-th frame received from a graphics processor after a PSR starting signal for controlling a start of the PSR mode into refresh image data, the refresh image data being the compressed image data of the N-th frame;

a memory configured to store the refresh image data corresponding to the static image;

a comparator configured to compare image data of the N-th frame and refresh image data readout from the memory;

a compensator configured to generate a compensation value based on a grayscale difference between the image data of the N-th frame and the refresh image data and adding the compensation value to the refresh image data; and a data driver configured to generate a data voltage using refresh image data compensated by the compensator and outputting the data voltage to the display panel in the PSR mode, wherein the N-th frame is a selected frame corresponding to the static image in the PSR mode, and the display panel displays the static image corresponding to the refresh image data added to the compensation value.

2. The display apparatus of claim 1, wherein the compensation controller is configured to receive the PSR starting signal for controlling a start of the PSR mode, a PSR ending signal for controlling an end of the PSR mode, and a re-synchronization ending signal for controlling a start of the normal mode.

3. The display apparatus of claim 2, wherein the compensation controller controls the comparator and the compensator based on the PSR starting signal and the PSR ending signal.

4. The display apparatus of claim 2, wherein the display panel drives with a re-synchronization mode inserted between the PSR mode and the normal mode, the re-synchronization mode synchronizes a panel synchronization signal for driving the display panel with an original synchronization signal received from the graphics processor.

5. The display apparatus of claim 2, further comprising:

a light-source configured to provide the display panel with a light;

a light-source driver configured to control a luminance level of the light;

a luminance controller configured to control the light-source driver to generate a boosting light of a boosting luminance level in a re-synchronization mode, the boosting luminance level is higher than a normal luminance level of a normal light generated in the PSR mode and the normal mode.

6. The display apparatus of claim 5, wherein the luminance controller comprises a look-up table configured to store a plurality of boosting luminance levels depending on charging characteristics of the display panel.

7. The display apparatus of claim 2, wherein the compensation controller is configured to control a luminance controller based on the PSR ending signal and the re-synchronization ending signal.

8. A method of driving a display apparatus comprising:

compressing image data of an N-th frame received from a graphics processor after a PSR starting signal for controlling a start of the PSR mode into refresh image data, the refresh image data being the compressed image data of the N-th frame;

storing the refresh image data corresponding to a static image in a memory;

comparing image data of the N-th frame and the refresh image data readout from the memory;

generating a compensation value based on a grayscale difference between the image data of an N-th frame and the refresh image data;

adding the compensation value to the refresh image data; and driving a display panel using refresh image data added to the compensation value in the PSR mode, wherein the N-th frame is a selected frame corresponding to the static image in the PSR mode, and the display panel displays the static image corresponding to the refresh image data added to the compensation value.

9. The method of claim 8, further comprising:

displaying by the display panel a normal image in a normal mode and a static image in a PSR (Panel Self Refresh) mode; and receiving the PSR starting signal for controlling a start of the PSR mode, a PSR ending signal for controlling an end of the PSR mode, and a re-synchronization ending signal for controlling a start of the normal mode.

10. The method of claim 9, further comprising:

determining a PSR period when the display panel is driven in the PSR mode, based on the PSR starting signal and the PSR ending signal; and driving the display panel using the refresh image data added to the compensation value during the PSR period.

11. The method of claim 9, further comprising: driving the display panel in a re-synchronization mode inserted between the PSR mode and the normal mode, wherein the re-synchronization mode synchronizes a panel synchronization signal for driving the display panel with an original synchronization signal.

12. The method of claim 9, further comprising: providing the display panel with a boosting light during a re-synchronization mode, the boosting light has a boosting luminance level greater than a normal luminance level of a normal light generated during the PSR mode or the normal mode.

13. The method of claim 12, wherein the boosting luminance level is determined using a look-up table storing a plurality of boosting luminance levels depending on charging characteristics of the display panel.

14. The method of claim 9, further comprising: determining a re-synchronization period when the display panel is driven in the re-synchronization mode, based on the PSR ending signal and the re-synchronization ending signal.

15. A display apparatus comprising:

a timing controller comprising;

a compensation controller configured to output a normal image in a normal mode or a static image in a Panel Self Refresh (PSR) mode, control a comparator and a compensator, and generate a refresh image data by compressing an image data of an N-th frame received from a graphics processor after a PSR starting signal for controlling a start of the PSR mode;

a memory configured to store the refresh image data;

the comparator configured to generate a grayscale difference based on a comparison between the image data of the N-th frame and the refresh image data; and the compensator configured to determine a compensation value based on the grayscale difference, and adds the compensation value and the refresh image data, wherein the N-th frame is a selected frame corresponding to the static image in the PSR mode, a display panel; and a data driver configured to generate a data voltage based on the compensation value added to the refresh image data, and output the data voltage to the display panel, wherein the display panel displays the static image corresponding to the refresh image data added to the compensation value in the PSR mode.

16. The display apparatus of claim 15, wherein the compensation controller receives the PSR starting signal and a PSR ending signal from a graphics processor, determines a PSR period of the PSR mode based on the PSR starting signal and the PSR ending signal, and operates the comparator and the compensator during the PSR period.

17. The display apparatus of claim 16, wherein the compensation controller activates a luminance controller when the PSR ending signal is received, and the compensation controller deactivates the luminance controller when a re-synchronization ending signal is received.

18. The display apparatus of claim 17, further comprising:

a light-source configured to provide the display panel with a light;

a light-source driver configured to control a luminance level of the light; and the luminance controller includes a luminance look-up table, the look-up table is configured to store a plurality of boosting luminance levels depending on charging characteristics of the display panel and the luminance controller is configured to provide the light-source driver with a boosting luminance level based on a control signal from the compensation controller.

* * * * *